US007774876B2

(12) United States Patent
Brown et al.

(10) Patent No.: US 7,774,876 B2
(45) Date of Patent: Aug. 17, 2010

(54) TILTING BED

(75) Inventors: Bobby Brown, Lubbock, TX (US); Randy Holloway, Lubbock, TX (US); Donny Hicks, Lubbock, TX (US); Larry Hambrick, San Angelo, TX (US)

(73) Assignee: Stand-Up Bed Company, Lubbock, TX (US)

( * ) Notice: Subject to any disclaimer, the term of this patent is extended or adjusted under 35 U.S.C. 154(b) by 268 days.

(21) Appl. No.: 11/417,051

(22) Filed: May 4, 2006

(65) Prior Publication Data

US 2007/0000058 A1 Jan. 4, 2007

Related U.S. Application Data

(60) Provisional application No. 60/677,335, filed on May 4, 2005.

(51) Int. Cl.
*A47B 7/00* (2006.01)
*A47B 7/02* (2006.01)

(52) U.S. Cl. ..... 5/611; 5/610

(58) Field of Classification Search ..... 5/610, 5/601, 624, 81.1 R, 83.1, 81.1 RP, 600, 611
See application file for complete search history.

(56) References Cited

U.S. PATENT DOCUMENTS 1,894,739 A * 1/1933 Gilbert ..... 5/648
2,764,763 A * 10/1956 Silver ..... 5/617
2,887,691 A 5/1959 Talarico et al.
3,036,314 A * 5/1962 Wetzler ..... 5/611
3,373,453 A * 3/1968 Goodman ..... 5/611
3,503,082 A * 3/1970 Kerwit ..... 5/601
3,609,777 A * 10/1971 Agnew et al. ..... 5/610
3,611,452 A * 10/1971 Turko et al. ..... 5/610
3,640,520 A * 2/1972 Wieland et al. ..... 5/610
3,806,109 A 4/1974 Weber et al.
3,964,786 A * 6/1976 Mashuda ..... 297/330
3,997,926 A 12/1976 England
4,059,255 A 11/1977 Perold
4,274,167 A 6/1981 Immel
4,535,492 A * 8/1985 Sebest ..... 5/616
4,556,198 A * 12/1985 Tominaga ..... 5/611
4,613,997 A 9/1986 Langdale
4,780,919 A * 11/1988 Harrison ..... 5/600
4,987,622 A 1/1991 Shockey
5,074,000 A * 12/1991 Soltani et al. ..... 5/611
5,103,512 A 4/1992 DiMatteo et al.

(Continued)

OTHER PUBLICATIONS

Brochure for Tilt Table—Model 600T, on sale more than one year prior to May 4, 2005.

(Continued)

*Primary Examiner*—Peter M Cuomo
*Assistant Examiner*—Alyson M Merlino
(74) *Attorney, Agent, or Firm*—Sterne, Kessler, Goldstein & Fox P.L.L.C.

(57) ABSTRACT

A bed includes a deck assembly that is supported by a base assembly. The base assembly includes a tilting actuator assembly. The base assembly is coupled to the deck assembly so that the deck assembly can be tilted from a prone position to an upright position. The base assembly and the deck assembly are coupled so that there are no easily accessible pinch points therebetween.

9 Claims, 12 Drawing Sheets

U.S. PATENT DOCUMENTS 5,136,742 A 8/1992 Stebbins et al.
5,205,004 A 4/1993 Hayes et al.
5,230,112 A 7/1993 Harrawood et al.
5,230,113 A 7/1993 Foster et al.
5,275,175 A 1/1994 Poirier et al.
5,299,334 A 4/1994 Gonzalez
5,317,769 A 6/1994 Weismiller et al.
5,345,632 A 9/1994 Langenaeken et al.
5,346,280 A 9/1994 Deumite
5,361,433 A 11/1994 Vanzant
5,361,436 A 11/1994 Hahn
5,404,604 A * 4/1995 Has et al. ..... 5/617
5,416,939 A 5/1995 Maalouli
5,513,867 A 5/1996 Bloswick et al.
5,586,349 A 12/1996 Hannant
5,621,933 A 4/1997 Knapp et al.
5,720,059 A 2/1998 Allevato et al.
5,774,915 A 7/1998 Scott et al.
5,782,870 A 7/1998 McAfee
5,790,996 A 8/1998 Narfström
5,864,901 A 2/1999 Blümel
5,916,085 A 6/1999 Wells
5,935,061 A * 8/1999 Acker et al. ..... 600/304
6,058,533 A * 5/2000 Nelson ..... 5/610
6,070,281 A 6/2000 Reich
6,119,287 A * 9/2000 Phillips ..... 5/81.1 RP
6,163,903 A 12/2000 Weismiller et al.
6,209,463 B1 * 4/2001 Koharchik et al. ..... 108/7
6,243,897 B1 6/2001 Sumiya
6,353,949 B1 3/2002 Falbo
6,473,922 B1 11/2002 Sommerfeld et al.
6,481,688 B1 * 11/2002 Welling et al. ..... 248/694
6,484,332 B2 11/2002 Korver, II et al.
6,557,940 B2 5/2003 Hayashi et al.
6,615,430 B2 9/2003 Heimbrock
6,681,423 B2 1/2004 Zachrisson
6,721,976 B2 4/2004 Schwaegerle
6,739,004 B1 5/2004 Abrahamsen et al.
6,846,042 B2 1/2005 Hanson et al.
6,862,762 B1 3/2005 Johnson et al.
6,868,567 B2 3/2005 Edgerton
6,912,746 B2 7/2005 Grove
6,954,951 B2 10/2005 Lieboff et al.
6,957,456 B2 * 10/2005 Darling et al. ..... 5/509.1
6,957,461 B2 10/2005 Osborne et al.
6,971,131 B2 12/2005 Bannister
6,978,501 B2 12/2005 Vrzalik
6,986,179 B2 1/2006 Varadharajulu et al.
7,000,271 B2 2/2006 Varadharajulu
7,073,222 B1 7/2006 Skripps
7,097,189 B2 8/2006 Hsu
7,125,167 B2 10/2006 Alakkat
7,181,793 B2 2/2007 Lee
7,255,397 B2 8/2007 Olcheski
7,373,677 B2 5/2008 Barthelt
7,472,441 B1 1/2009 Steffensmeier
2002/0066142 A1 * 6/2002 Osborne et al. ..... 5/600
2002/0148044 A1 * 10/2002 Hayes et al. ..... 5/618
2003/0086749 A1 * 5/2003 Oliver et al. ..... 403/13
2003/0101513 A1 * 6/2003 Wong ..... 5/601
2004/0128766 A1 * 7/2004 Freeborn et al. ..... 5/611

OTHER PUBLICATIONS

Brochure for Tilt Table—Model TT-700, on sale more than one year prior to May 4, 2005.

* cited by examiner

TILTING BED

CROSS-REFERENCE TO RELATED APPLICATIONS

The present application claims the benefit of U.S. Provisional Application No. 60/677,335, filed May 4, 2005, entitled "Tilting Bed." U.S. Provisional Application No. 60/677,335 is incorporated in its entirety herein by reference thereto.

BACKGROUND OF THE INVENTION

1. Field of the Invention

The invention relates to beds and in particular to beds having a tiltable deck.

2. Background of the Invention

As people age or suffer a deterioration in health it often becomes difficult to perform simple activities. It is often necessary for those people to receive assistance for activities such as getting into or out of bed. The assistance may take many forms. For example, assistance from another person may be provided. However, such a solution is often costly and it may be inconvenient or undesirable for both parties. Various mechanisms have been devised to provide the needed assistance. In particular, beds have been designed that mechanically tilt a person from a lying position to a standing position and vice versa.

The beds that include tilting mechanisms have generally included large frames that are coupled to the outer edges of a deck. The frames generally include at least one frame member that extends along the outer surface of the bed deck. The deck is secured to the frame at pivot points so that it can be pivoted with respect to the frame between a horizontal position and a vertical position. When the deck is tilted to a vertical position, the frame often extends past the deck on both lateral sides. This results in an overall footprint for the bed that is unnecessarily large because the frame must be large enough to support the deck on the outer edge. In addition, when the deck is tilted it often passes adjacent to frame members. The close proximity between the deck and frame creates pinch points at numerous locations. Since the frame and deck interface at an outer edge of the deck, it is easy for a user to unwittingly place a body part in one of the pinch points and become injured during a tilting operation.

Additionally, in beds that include tilting mechanisms the pivot point is often located close to the longitudinal center of the deck. With such a configuration, in order for the deck to be tilted to a vertical position, the pivot point must be located high off the ground. Since that height also corresponds to the height of the deck when it is in the horizontal position it often results in the bed deck being so high that persons, particularly those with limited physical mobility, can find it difficult to get onto the mattress when the deck is horizontal.

There is a need for a bed having a tiltable deck that is lower to the ground and safer to operate.

SUMMARY OF THE INVENTION

One embodiment is a bed that includes a deck assembly that is supported by a base assembly. The deck assembly is pivotally connected at three points to leg members and a tilting actuator assembly that are included in the base assembly. The leg members and the tilting actuator assembly are configured such that there is no pinch point between the base assembly and the deck assembly when the deck assembly is rotated between a prone position and an upright position. The pivot points are located so that the deck assembly can rest near a support surface when it is in a prone position.

In another embodiment, a bed includes a deck assembly that is supported by and coupled to a base assembly at three points. The deck assembly is coupled to actuated leg members and a tilting actuator assembly that are included in the base assembly. The leg members and the tilting actuator assembly are configured such that there is no pinch point between the base assembly and the deck assembly when the deck assembly is rotated between a prone position and an upright position. The base assembly also includes a cart actuator assembly that moves the tilting actuator assembly. Movement of the tilting actuator assembly by the cart actuator assembly and movement of the actuated leg members allows the deck assembly to move up or down to raise or lower the deck with respect to the ground while the deck is horizontal.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art based on the teachings contained herein.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE DRAWINGS

Specific embodiments of the present invention are now described with reference to the figures, where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention.

Figure 1:
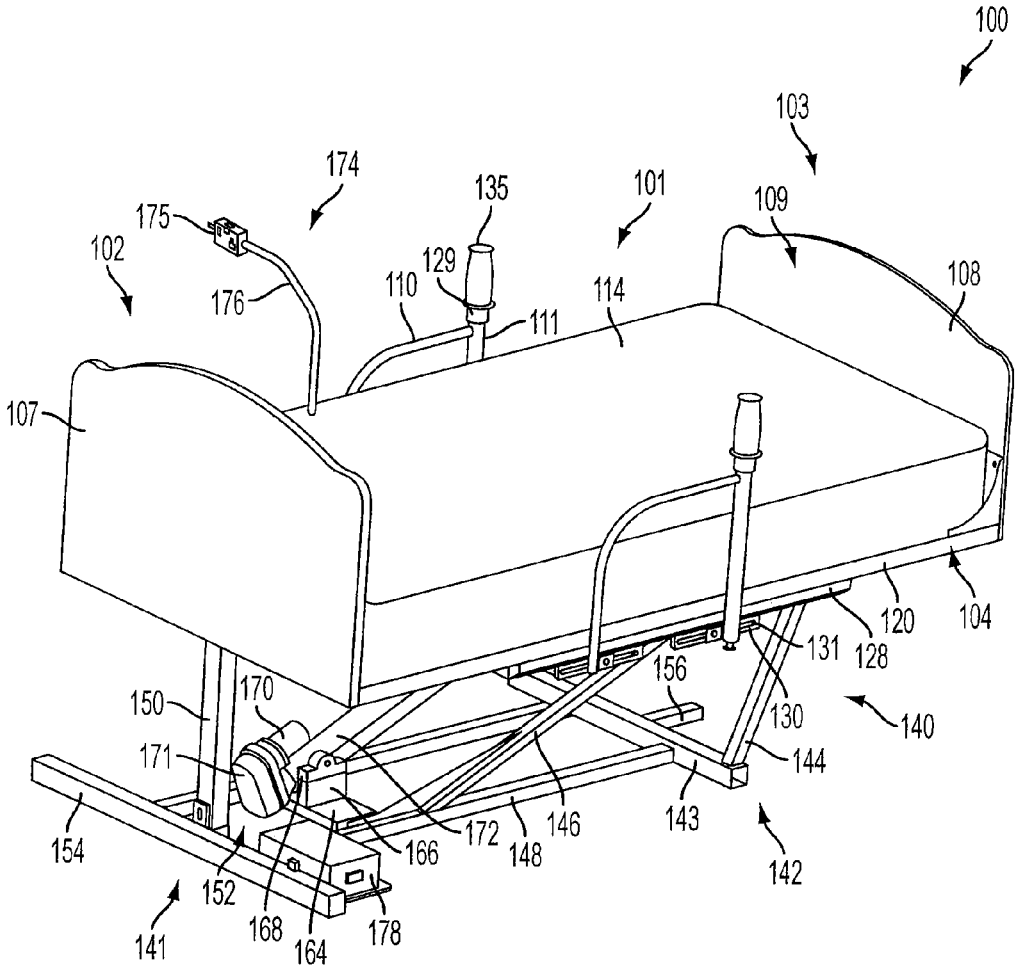
FIG. 1 is a side elevation view of an embodiment of a bed having a deck assembly in a prone position.
Figure 2:
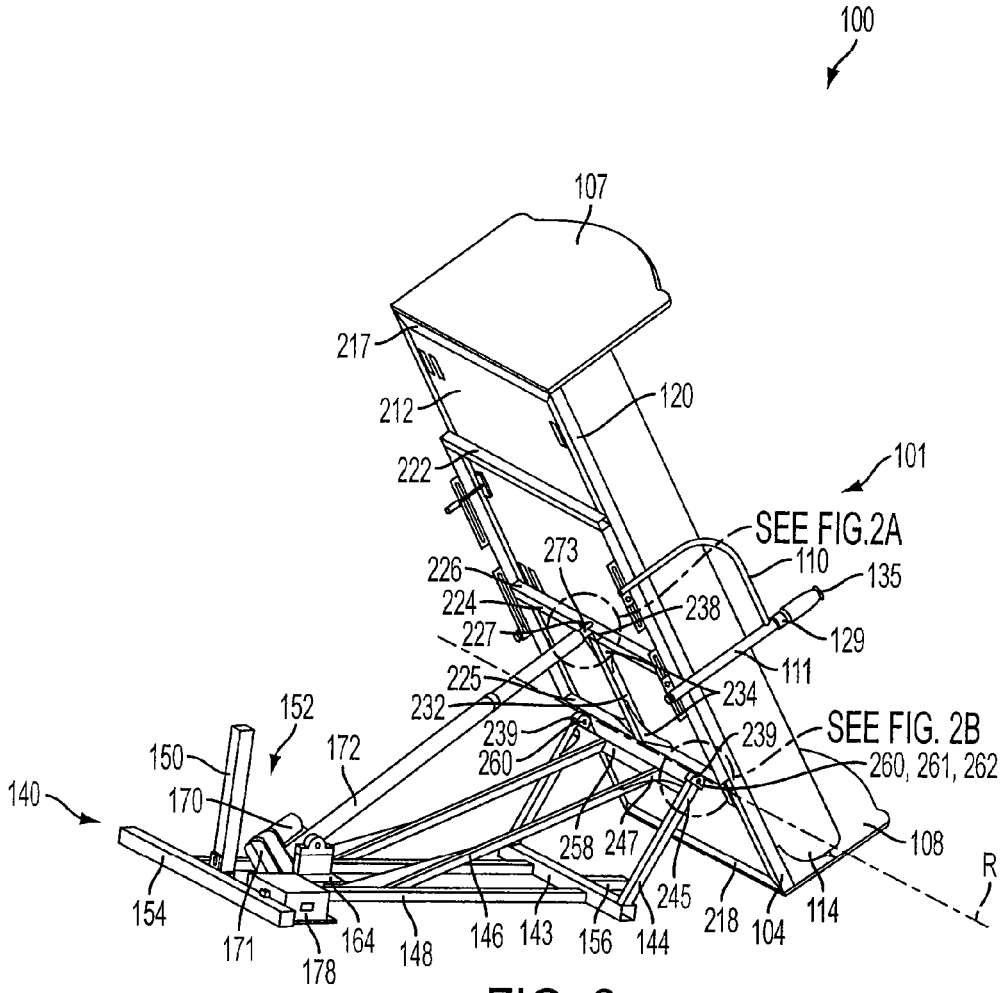
FIG. 2 is a side elevation view of the bed of FIG. 1 with the deck assembly tilted between the prone position and an upright position.

Referring first to FIGS. 1 and 2, a bed 100 is illustrated. Bed 100 generally is constructed from a deck assembly 101 and a base assembly 140. Deck assembly 101 provides the lying surface for a user. Base assembly 140 provides the support for holding deck assembly 101 above a support surface, such as a floor, and an actuation mechanism for tilting deck assembly 101. Deck assembly 101 may be tilted from a prone position, shown in FIG. 1, to a fully upright position, shown in FIG. 4, to assist a person who may otherwise have difficulty lying down on a bed or getting out of a bed.

Deck assembly 101 includes an upper frame 104, a headboard 107, a footboard 108, a pair of hand rails 110, a support plate 212 and a mattress 114. Upper frame 104 provides a stable support upon which support plate 212 and mattress 114 are secured. Upper frame 104 is a steel structure that includes a headboard support 217 at a head end 102 of deck assembly 101, a footboard support 218 at a foot end 103 of deck assembly 101 and a pair of longitudinal frame rails 120 that are substantially parallel to each other and extend between headboard support 217 and footboard support 218. Headboard support 217, footboard support 218 and frame rails 120 are coupled, for example by welding or bolts, such that they form the rectangular perimeter of upper frame 104. Support plate 212 may be made of metal, such as steel, aluminum or titanium; plastic; wood; or any other suitable material.

Headboard 107 and footboard 108 may be bolted to headboard and footboard support 217, 218, respectively so that they are removable for ease of shipping. Headboard 107 may be constructed from a sheet of plywood or any other suitable material. Headboard 107 may be finished with laminate surfaces or paint. Footboard 108 may be constructed from aluminum or any other suitable material. Footboard 108 may include a non-slip surface 109 and otherwise may be finished with a laminate surface or paint.

Upper frame 104 also includes a cross support member 222, first and second angle supports 224 and 225, a reinforcing plate 226, handrail guide members 128 and a spine member 232. In one embodiment, cross support member 222 is made from a steel tube that extends across the width of upper frame 104 and is spaced from headboard support 217 at the approximate location corresponding to a user's head and shoulders. Cross support member 222 provides additional strength and rigidity to upper frame 104. First and second angle supports 224 and 225 also extend across the width of upper frame 104 generally parallel to cross support member 222. First angle support 224 is spaced from cross support member 222 toward footboard support 218 and second angle support 225 is spaced from first angle support 224 also in the direction of footboard support 218. Reinforcing plate 226 is coupled to the edge of first angle support 224 closest to cross support member 222. Reinforcing plate 226 includes a slot 227 that provides clearance for tilting actuator assembly 152 to rotate. In this embodiment, first and second angle supports 224 and 225 are made from steel angle stock and reinforcing plate 226 is made from steel.

Figure 2A:
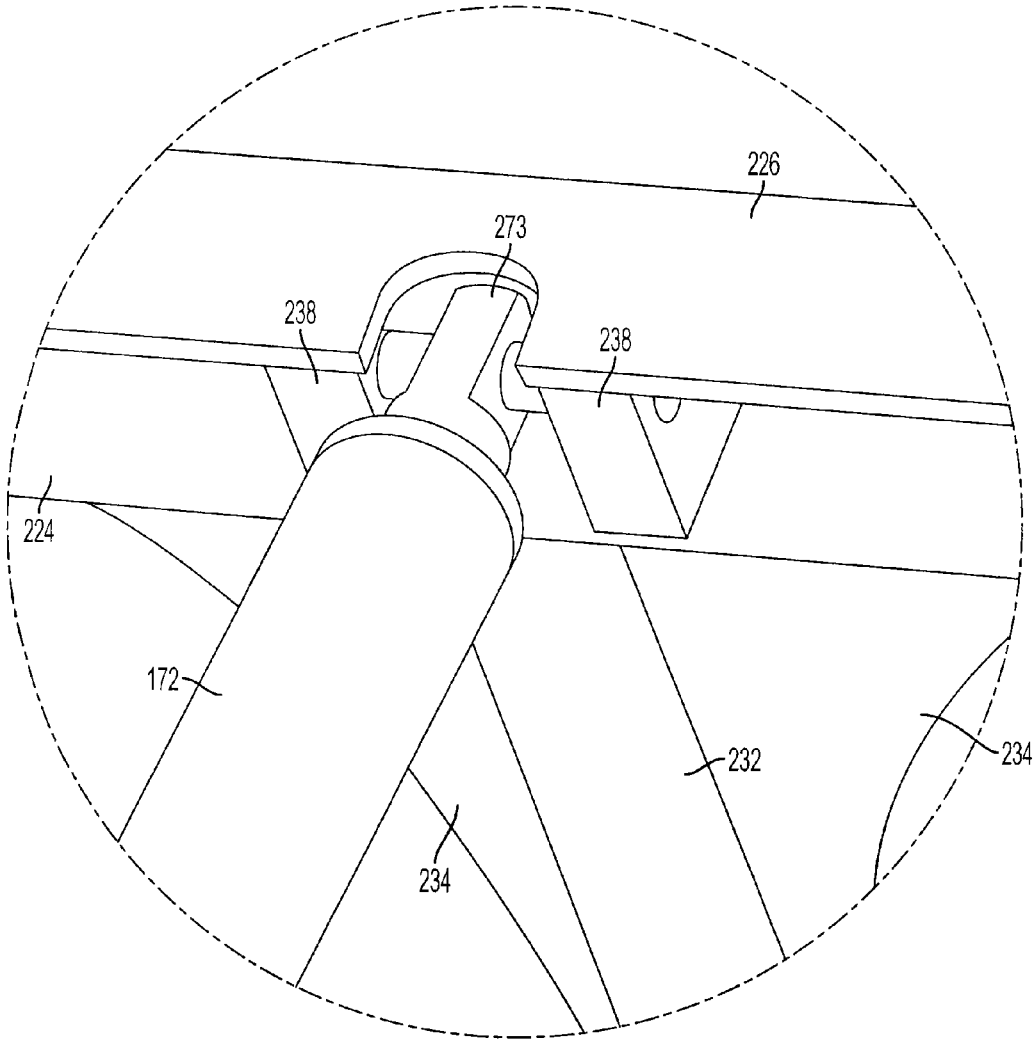
FIG. 2A is a side view of a portion of the bed of FIG. 1, indicated as portion "a" in FIG. 2.
Figure 2B:
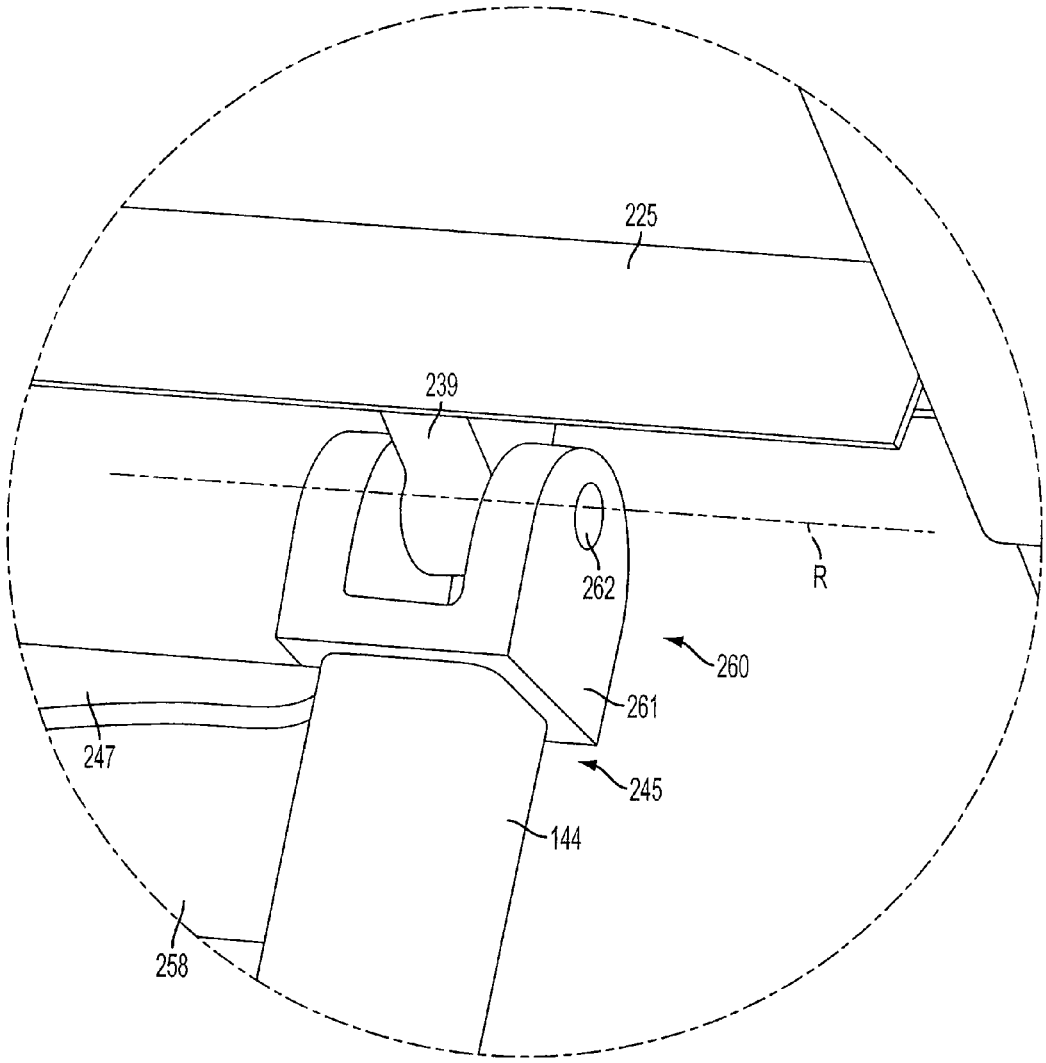
FIG. 2B is a side view of a portion of the bed of FIG. 1, indicated as portion "b" in FIG. 2.

A pair of actuator lugs 238 are secured to first angle support 224 and reinforcing plate 226, as shown in FIG. 2A. A pair of foot pivot lugs 239 is secured to second angle support 225, as shown in FIG. 2B. Actuator lugs 238 and foot pivot lugs 239 provide connection points between deck assembly 101 and base assembly 140 as described in greater detail below.

Figure 3:
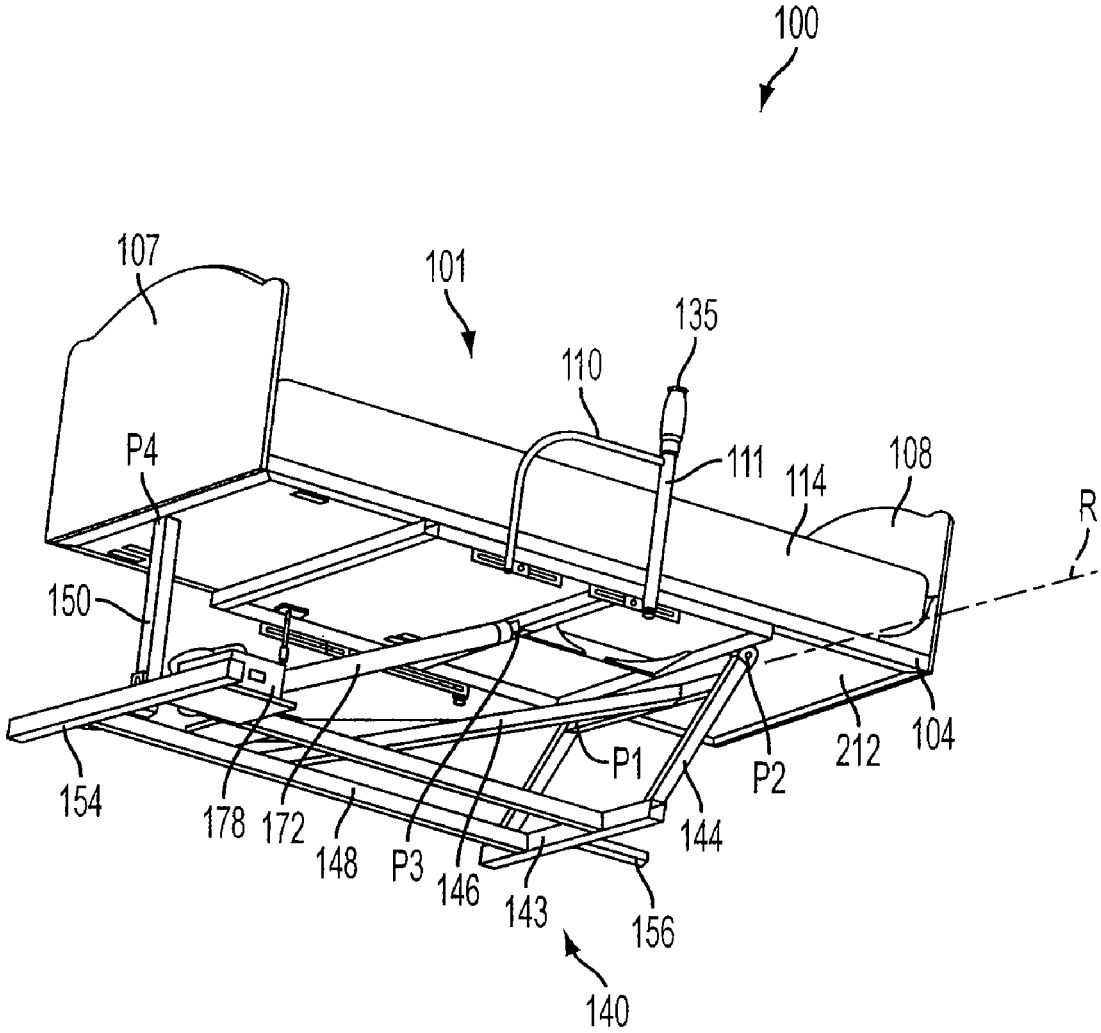
FIG. 3 is a side view from beneath the bed of FIG. 1 with the deck assembly in the prone position.

When deck assembly 101 is in the prone position, it is supported by three pivot points P1, P2, P3 and a fourth point P4 provided by a vertical support 150 included in base assembly 140, as shown in FIG. 3. In one embodiment, vertical support 150 is made from steel tubing. Vertical support 150 extends vertically from a counterweight 154 and provides a support surface for deck assembly 101 when it is in the prone position. The components of upper frame 104 may be welded together so that upper frame 104 is rigid enough to resist bending or twisting when weight is distributed unequally on deck assembly 101.

Handrail guide members 128 extend from cross member 222 toward footboard support 218 along frame rails 120. Spine member 232 is coupled to and extends between angle supports 224 and 225 and is parallel to frame rails 120. Gussets 234 are included to strengthen upper frame 104 at the locations where spine member 232 is coupled to angle supports 224 and 225.

Hand rails 110 are included on deck assembly 101. Hand rails 110 may be adjustably coupled to upper frame 104 via hand rail guides 130. Hand rail guides 130 may be coupled to handrail guide members 128 and can include hand rail guide slots 131. In one embodiment, hand rails 110 are connected to hand rail guides 130 at slots 131 such that the positions of hand rails 110 are adjustable in the direction of a longitudinal axis of upper frame 104.

In one embodiment, grips 135 are included on hand rails 110 so that a user may easily grip a portion of hand rails 110 while deck assembly 101 is tilting to an upright position. Grips 135 also provide a stable support to assist a user while they step off or on footboard 108 after deck assembly 101 is in an upright position.

The positions of grips 135 may be adjustable with respect to their distance from upper frame 104. Each grip 135 may be mounted on a grip rod (not shown) that is slidably coupled within a tubular portion 111 of hand rail 110. In one embodiment, a pair of grip locking wedges (not shown) are threadably coupled to an end of the grip rod opposite grip 135. The grip rod can be locked within tubular portion 111 of hand rail 110 by rotating grip 135 in a direction that draws the grip locking wedges toward each other and toward grip 135. As the locking wedges interface, the locking wedges are forced to move laterally outward from a longitudinal axis of the grip rod and against an inner surface of tubular portion 111 of hand rail 110. As a result, the grip rod may be locked in place at any location within tubular portion 111. A hand rail lock cap 129 may also be included on hand rail 110 to further lock the grip rod in place. It should be appreciated that any locking mechanism known in the art may be incorporated into hand rail 110 and grip 135.

In one embodiment, base assembly 140 includes a foot member 143, leg members 144, angle members 146, base rails 148, vertical support 150, a tilting actuator assembly 152 and counterweight 154. Foot member 143 is located at a foot end 142 of base assembly 140. Base rails 148 are secured to foot member 143, for example by welding, bolts or any other suitable fastener, and extend toward a head end 141 of base assembly 140. Counterweight 154 is located at head end 141 of base assembly 140 and may be secured to base rails 148. Counterweight 154 extends out beyond the front edge of headboard 107 so that when deck assembly 101 is lowered, and base assembly 140 is pushed up against a wall, headboard 107 will not hit the wall as deck assembly 101 is tilted. In this embodiment, counterweight 154 is a solid steel rod that provides weight to counteract the forces created when deck assembly 101 is in an upright position. In one embodiment, counterweight 154 is approximately 45 lbs.

In addition, a balance member 156 may extend from foot member 143 away from counterweight 154 in a common plane with base rails 148 and counterweight 154. Balance member 156 increases the effective length of base assembly 140, thereby increasing the moment provided by counterweight 154. That moment counteracts forces that would otherwise cause bed 100 to tip when deck assembly 101 is tilted to the upright position. Balance member 156 is sized so that it does not interfere with the footbed when the deck is substantially vertical.

In one embodiment, the combined foot member 143, base rails 148, counterweight 154 and balance member 156 form the portion of base assembly 140 that rests on a support surface (i.e., a floor). In the embodiment shown, foot member 143, base rails 148 and balance member 156 are constructed from steel tube stock that has a square cross-section. Counterweight 154 has a square cross-section. The square cross-section provides additional ground contacting surface area, but such a cross-section is not required. It should be appreciated that foot member 143, base rails 148, balance member and/or counterweight 154 may have circular or other polygonal cross sections. It should also be appreciated that foot member 143, base rails 148 and/or balance member may also be constructed from solid rod rather than tube stock. The components may be made of aluminum, titanium, composites or any other material known in the art that provides sufficient counterweight.

In this embodiment, base rails 148 are secured to foot member 143 by welding. Counterweight 154 may be bolted to base rails 148 so that it can be removed for easier shipping of base assembly 140. It should be appreciated that counterweight 154 may be welded to base rails 148 and/or base rails 148 may be bolted to foot member 143.

Figure 4:
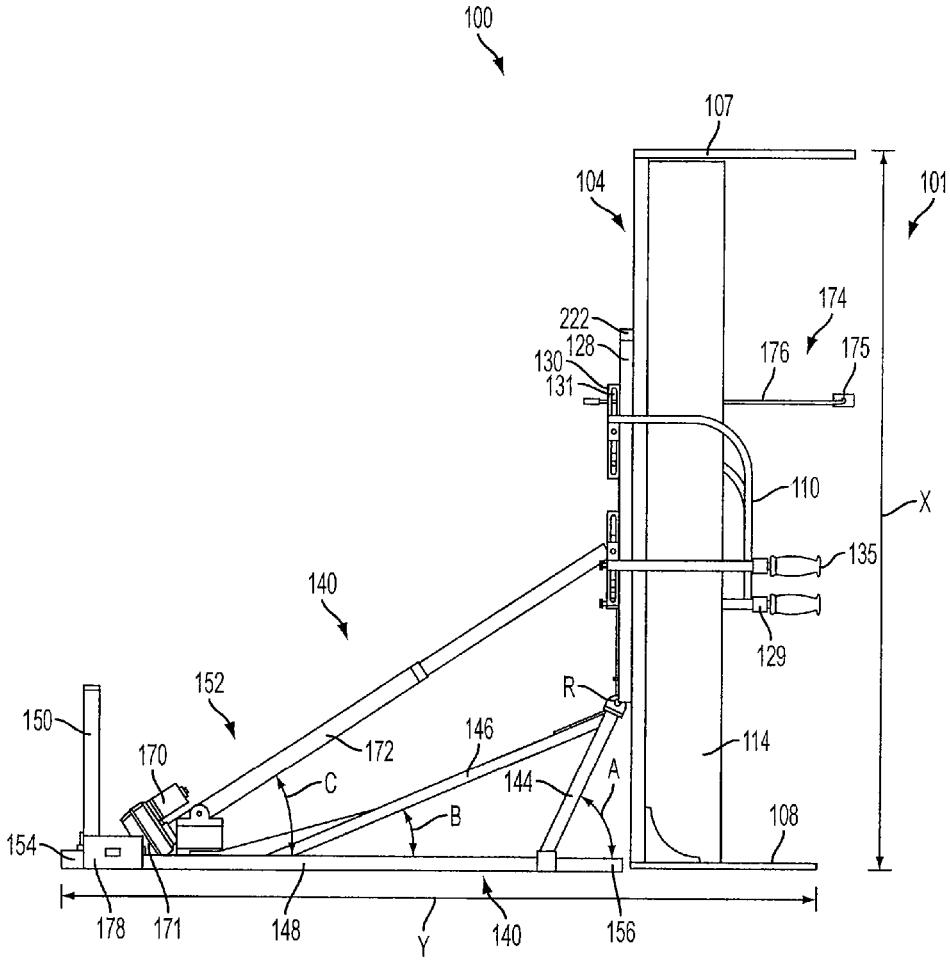
FIG. 4 is a side view of the bed of FIG. 1 with the deck assembly in the upright position.

Leg members 144 extend upward from foot member 143 and away from counterweight 154. Near an upper end 245 of leg members 144, a cross support 258 may extend between leg members 144. Leg members 144 may be angled with respect to base rails 148 by an angle A, as shown in FIG. 4. Angle members 146 extend upward from respective base rails 148 and away from counterweight 154 to cross support 258. Angle members 146 may be angled with respect to base rails by an angle B, as shown in FIG. 4. Angle member gussets 247 may be included at the joint between angle members 146 and cross support 258 to provide additional strength.

In one embodiment, a pivot lug 260 is provided at upper end 245 of each leg member 144, as shown in FIG. 2B. Each pivot lug 260 may be a U-shaped bracket that includes two parallel walls 261 and a pair of pivot apertures 262. In one embodiment, each pivot aperture 262 is located in a respective wall 261 and pivot apertures 262 may be aligned on a pivot axis R.

In one embodiment, a pillow block base 164 may extend between base rails 148 near counterweight 154. Pillow block base 164 may be a plate that may be coupled to each of base rails 148. A pair of pillow block risers 166 may be mounted to pillow block base 164 and a pair of pillow blocks 168 may be mounted to pillow block risers 166.

In one embodiment, tilting actuator assembly 152 is pivotally suspended between pillow blocks 168 such that an angle C (shown in FIG. 4) taken between base rails 148 and a telescoping arm 172 varies during operation. Tilting actuator assembly 152 may be a linear actuator that includes a motor 170, a motor coupling 171 and telescoping arm 172. An actuator pivot lug 273 may be coupled to telescoping arm 172 at an end opposite from motor coupling 171. Tilting actuator assembly 152 may be any commercially available linear actuator assembly capable of tilting deck assembly 101 as described in greater detail below.

A control stalk 174 includes relay switches 175 and an adjustable arm 176. Relay switches 175 may be used to control the operation of tilting actuator assembly 152 and any additional accessories (e.g., a reading light and laser lights) included on bed 100. Adjustable arm 176 may be constructed from a hollow, flexible conduit that is articulated such that it can be easily positioned and once positioned will retain the shape. Adjustable arm 176 may be rigidly coupled to upper frame 104. Wiring from switches 175 may be routed through the bore provided in adjustable arm 176.

A power supply box 178 may be mounted to base assembly 140 and electrically coupled to relay switches 175. In one embodiment, power supply box 178 includes an AC to DC power converter and a 12 V DC battery. Power supply box 178 may also contain control logic for controlling the output of tilting actuator mechanism 152 in response to a user toggling a relay switch 175. The control logic and power converter may be configured such that AC power entering the power converter from a wall plug is converted to DC power to charge the battery. Tilt actuator mechanism 152 and any accessories may be powered by DC power. Such a configuration allows bed 100 to be temporarily operated after loss of AC power without interruption. It should be appreciated that voltages other than 12 V DC may be used.

Additional accessories, such as a reading light and laser lights may be included on headboard 107. The reading light may include a light source on an adjustable stalk (not shown). The light source can be turned on or off to provide light for a user. The laser lights may be included to provide a stimulus for patients that suffer from Parkinson's Disease. It has been shown that if Parkinson's patients are provided with a stimulus to visually focus on it may help to stimulate their motor functions. The laser lights may be configured so that when deck assembly 101 is in a prone position a first laser is projected onto the ceiling of the room. When the deck is in a vertical, or upright position, this first laser light shines on the wall in front of the bed. A second laser light may be configured so that when deck assembly 101 is in an upright position, a laser is projected onto the support surface a short distance in front of footboard 108. In one embodiment, this distance is between 4 to 6 feet in front of the footboard.

As previously described, deck assembly 101 may be pivotally coupled to base assembly 140 at three points. Foot pivot lugs 239 of upper frame 104 may be coupled to pivot lugs 260 of leg members 144 and actuator lug 238 of upper frame 104 may be coupled to actuator pivot lug 273 of tilting actuator mechanism 152. In one embodiment, deck assembly 101, in the prone position, is supported at the three pivot points and a fourth support point provided by vertical support 150. From the prone position, deck assembly 101 may be tilted to an upright position, shown in FIG. 4, by extending telescoping arm 172 of tilting actuator assembly 152. When telescoping arm 172 is extended, it causes deck assembly 101 to rotate about pivot axis R corresponding to foot pivot lugs 239.

It should be appreciated that the length of deck assembly 101 (length X) can be made substantially equal to the combined length of base assembly 140 and footboard 108 (length Y) when deck assembly 101 is in the upright position, as shown in FIG. 4. In such an embodiment, the footprint of bed 100 is about the same when deck assembly 101 is in the prone position and in the upright position. In addition, deck assembly 101 overhangs from base assembly 140 in the direction of footboard 108 by an amount equal to the approximate height of upper ends 245 of leg members 144 from the support surface. The overhang of deck assembly 101 acts as a counterweight to assist tilting actuator assembly 152 in tilting deck assembly 101.

It should also be appreciated that the construction of bed 100 allows deck assembly 101 to be lower than conventional beds, if desired. In the present embodiment, when deck assembly 101 is in the horizontal position, the top of mattress 114 in deck assembly 101 is located approximately 28 inches from the support surface. As a result, it is easier for a user to get into or out of bed 100 when deck assembly 101 is in the horizontal position.

As shown in FIG. 4, when deck assembly 101 is in the upright position, upper frame 104 is vertical and base assembly 140 remains horizontal on the support surface. In such a configuration, footboard 108 is substantially parallel to the support surface and adjacent to balance member 156. It should be appreciated that angle A and the length of leg members 144 and the length of balance member 156 are chosen so that when deck assembly 101 is in an upright position deck assembly 101 and balance member 156 do not interfere. It should also be appreciated that a non-slip surface 109 may be provided on footbed 108 so a user can step on and off and stand on footboard 108 more easily or securely.

Bed 100 is also designed to minimize pinch points during the tilting of deck assembly 101. In particular, the configuration of leg members 144, angle members 146 and telescoping arm 172 assure that no pinch points are created between those components and upper frame 104 at any time while deck assembly is rotated between the prone and upright positions. The only locations that provide a potential for pinching are located along a longitudinal center line of bed 100, which are virtually inaccessible to a user. For instance, in one embodiment, when deck assembly 101 is in the prone position, upper frame 104 is supported by vertical support 150, that is located at the center of counterweight 154. Generally, headboard 107 would be located adjacent a wall when deck assembly 101 is in the prone position and the distance from a lateral edge of deck assembly 101 to vertical support 150 is such that it would be unlikely for a person to unwittingly place a body part between vertical support 150 and upper frame 104. When deck assembly 101 is in the upright position, the only potential pinch point is between balance member 156 and upper frame 104. However, similar to vertical support 150, balance member 156 is located along a longitudinal center line of base assembly 140. In addition, the motion of deck assembly 101 would prohibit a person from unwittingly placing a body part between deck assembly 101 and balance member 156 when deck assembly 101 is tilted to the upright position.

Figure 5:
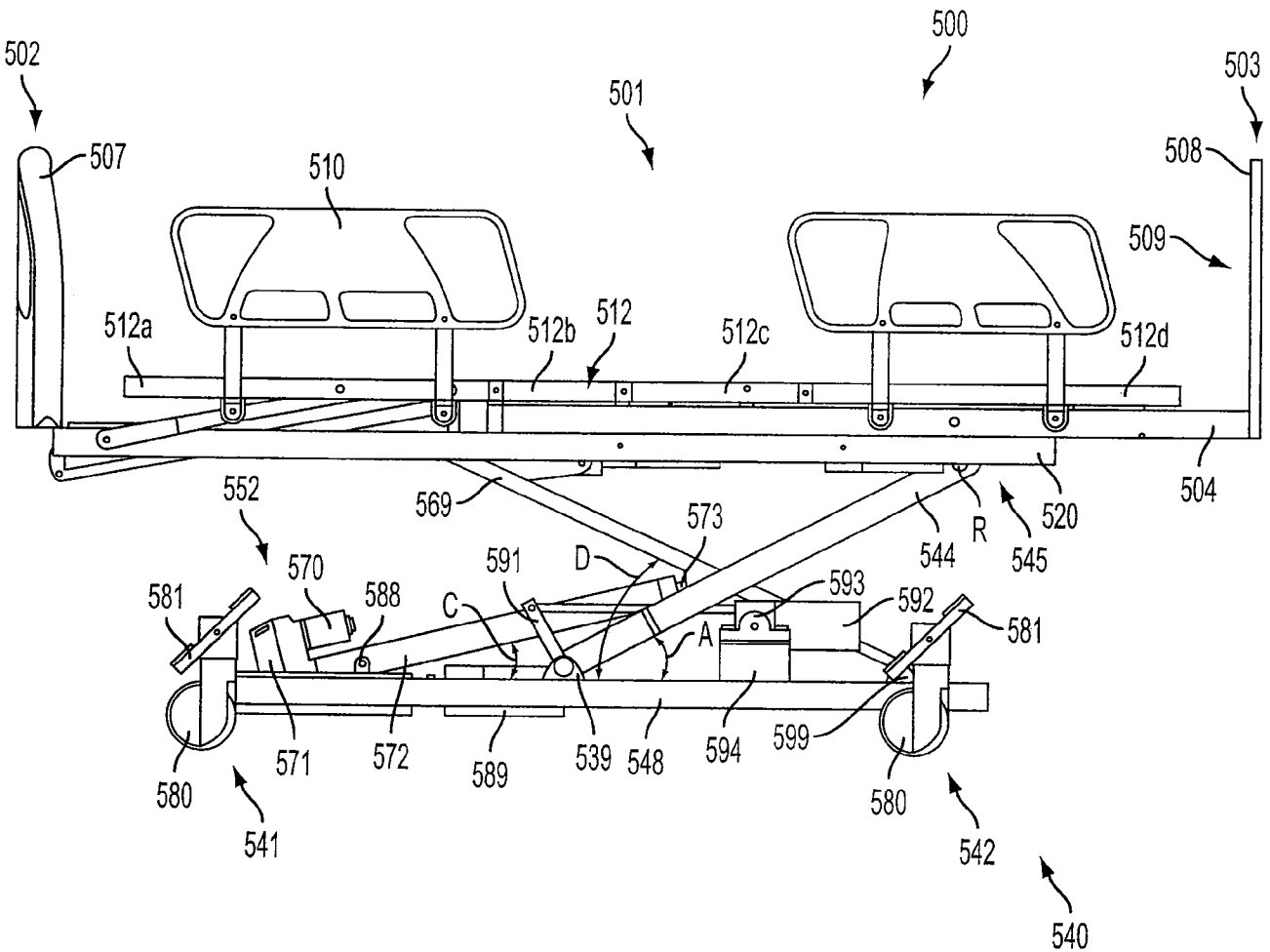
FIG. 5 is a side view of another embodiment of a bed having a deck assembly in a prone position.
Figure 6:
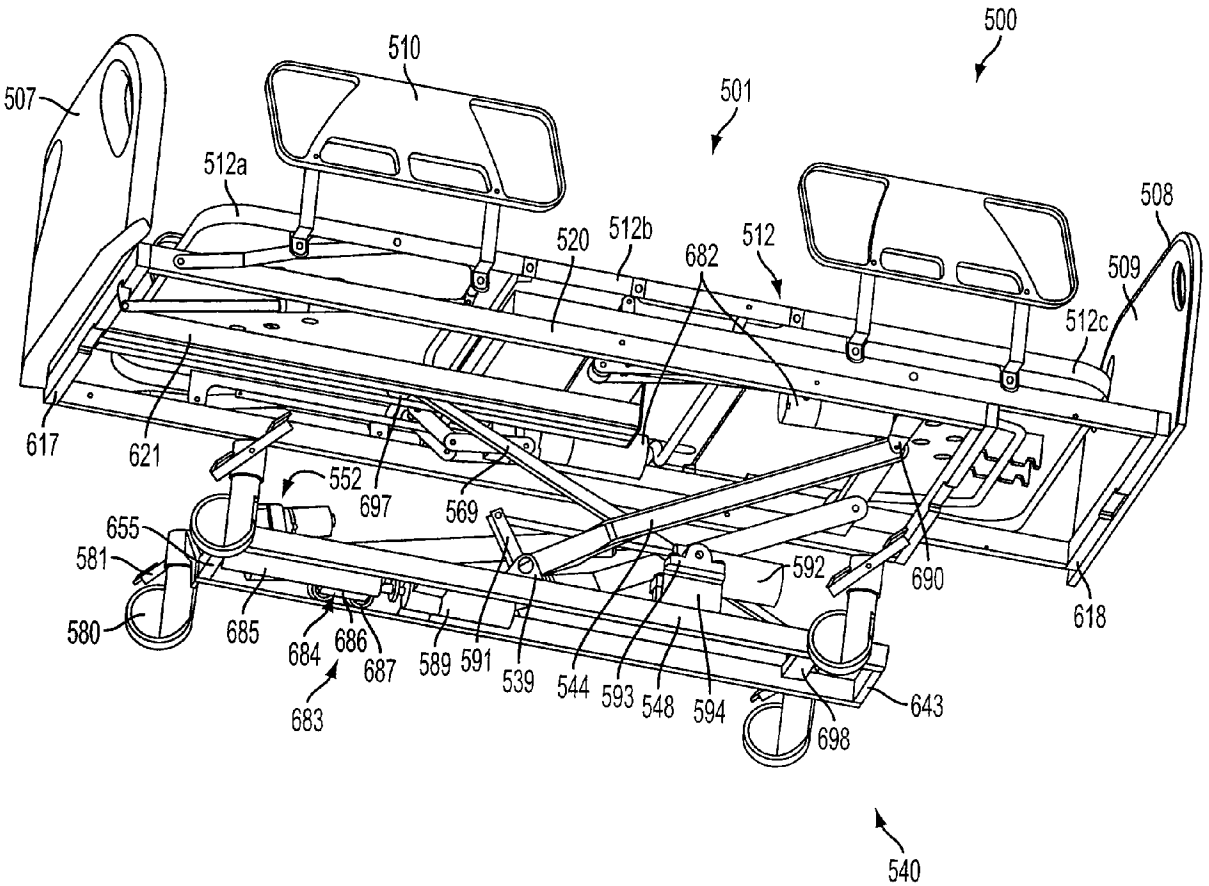
FIG. 6 is a side view from beneath the bed of FIG. 5 with the deck assembly in the prone position.
Figure 7:
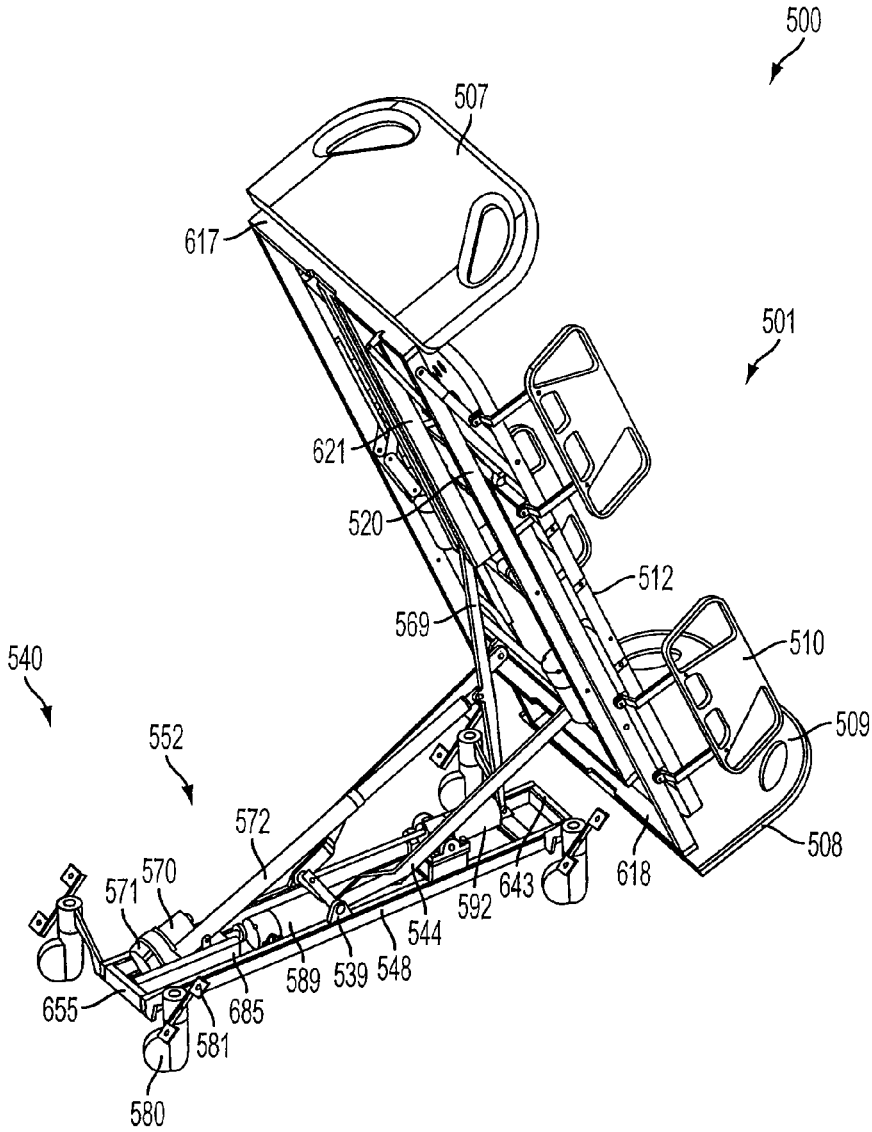
FIG. 7 is a side elevation view of the bed of FIG. 5 with the deck assembly tilted between the prone position and an upright position.

Another embodiment, bed 500, is shown in FIGS. 5-7. Bed 500 can be tilted from a prone position to a fully upright position to assist a user in getting into or out of bed 500, similar to bed 100. Bed 500, however, provides additional functionality when compared to bed 100 which makes it particularly well suited for use in a hospital setting. In particular, bed 500 includes a base assembly 540 that enables a deck assembly 501 to be tilted, as shown in FIG. 7, or to be raised or lowered vertically while deck assembly 501 remains horizontal. In addition, unlike the stationary base assembly 140 of bed 100, base assembly 540 contacts a support surface through casters 580 allowing bed 500 to be rolled on the support surface.

In one embodiment, deck assembly 501 includes an upper frame 504, a headboard 507, a footboard 508 having a non-slip surface 509, adjustable hand rails 510, a support plate 512 and a mattress (not shown). Upper frame 504 provides a stable support upon which support plate 512 and the mattress may be secured. Upper frame 504 may include a headboard support 617 at a head end 502 of deck assembly 501, a footboard support 618 at a foot end 503 of deck assembly 501 and longitudinal frame rails 520 that are substantially parallel to each other and extend between headboard support 617 and footboard support 618. Headboard support 617, footboard support 618 and frame rails 520 may be coupled such that they form the rectangular perimeter of upper frame 504.

Support plate 512 may be constructed from multiple support plate portions 512*a*, 512*b*, 512*c* and 512*d*. Support plate actuators 682 may be supported by upper frame 504 and coupled to portions 512*a*, 512*c* and 512*d* to allow these portions of support plate 512 to be raised and lowered to support the user in various positions as is generally customary in hospital beds. For example, support portion 512*a* may be raised to support a user's upper body in a sitting configuration and/or support portions 512*c* and 512*d* may be raised to raise the user's legs. Deck assembly 501 may be any conventional hospital bed deck that is modified to be mounted to base assembly 540 described below.

As shown in FIG. 6, a track 621 and a pair of foot pivot lugs 690 may be included on upper frame 504. Track 621 may be constructed from opposing channels, separated by a space, that extends from headboard support 617 toward footboard support along a longitudinal center line of upper frame 504. Foot pivot lugs 538 may be secured on a bottom surface of upper frame 504.

In this category of embodiments, base assembly 540 will generally include a foot member 643, actuated leg members 544, base rails 548, a head member 655, a tilting actuator assembly 552, a pivot arm 569, a cart actuator assembly 683 and casters 580. Foot member 643 may be located at a foot end 542 of base assembly 540. Base rails 548 may be secured to foot member 643 and extend toward a head end 541 of base assembly 540. Head member 655 may be located at head end 541 of base assembly 540 and secured to base rails 548.

The combined foot member 643, base rails 548, and head member 655 form a generally rectangular frame upon which the other components of base assembly 540 are mounted. Foot member 643, base rails 548 and head member 655 may be constructed from steel rod or tube and the components may be welded or bolted together or held together by any other suitable fastening means. In another embodiment, the components may be made from aluminum.

Casters 580 may be coupled to the corners of the combined foot member 643, base rails 548 and head member 655. Casters 580 may be rotatable along a vertical axis such that bed 500 can be rolled in any direction. A lock 581 may be provided on each caster 580 that selectively restricts a respective caster 580 from rolling. Sensors and lock actuators (not shown) may also be included with locks 581. The sensors sense when a lock 581 is placed in the locked position and may feed a signal to control logic of bed 500. The control logic may then provide a signal to the lock actuators that causes the lock actuators to configure all locks 581 in the locked position. The signal fed to the control logic from the sensors may also allow the actuators used to raise and lower deck assembly 501 to be enabled only when casters 580 are locked.

Figure 8:
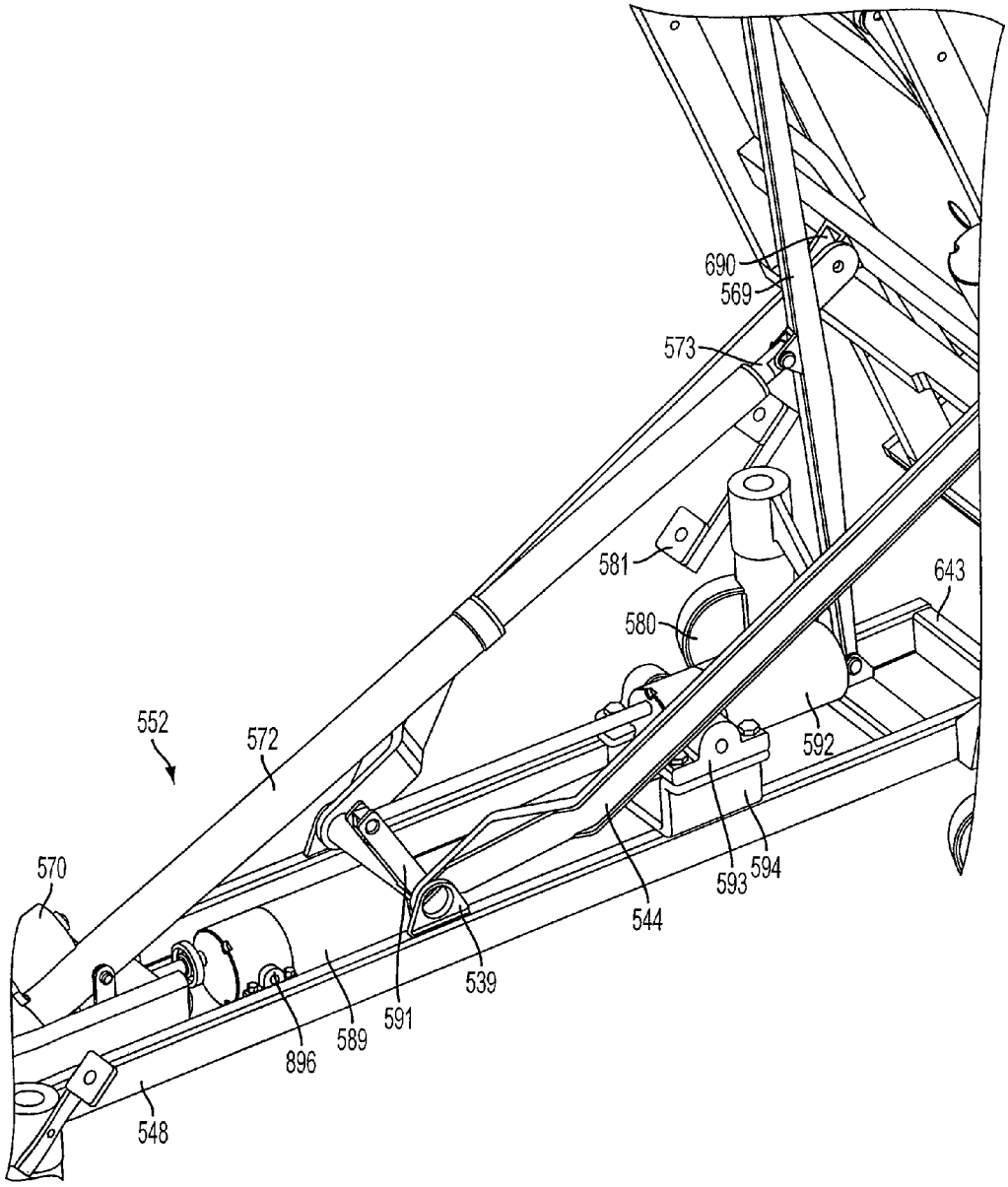
FIG. 8 is a side elevation view of a portion of a base assembly of the bed as shown in FIG. 7.

Leg members 544 extend upward from base rails 548 and away from head member 655. However, unlike leg members 144 of bed 100, leg members 544 may be actuated. As shown in FIG. 8, leg members 544 may be secured to each other and pivotally coupled to base rails 548 through leg member lugs 539. A pivot arm 591 may be secured to leg members 544 and a leg member actuator 592. Leg members 544 may be angled with respect to base rails 548 by an angle A (shown in FIG. 5)

that is variable by actuation of actuator 592. Actuator 592 may be secured to base rails 548 through pillow blocks 593 and a base 594.

Actuator 592 may be a linear actuator that is coupled to pivot arm 591 such that when an output arm of actuator 592 extends it pushes pivot arm 591 causing an increase in angle A. Conversely, when the output arm of actuator 592 is retracted, it can pull pivot arm 591 causing a decrease in angle A. Actuation of leg members 544 in combination with actuation of cart actuator assembly, described below, may be used to adjust the height of deck assembly 501 while it remains in a horizontal position.

Figure 9:
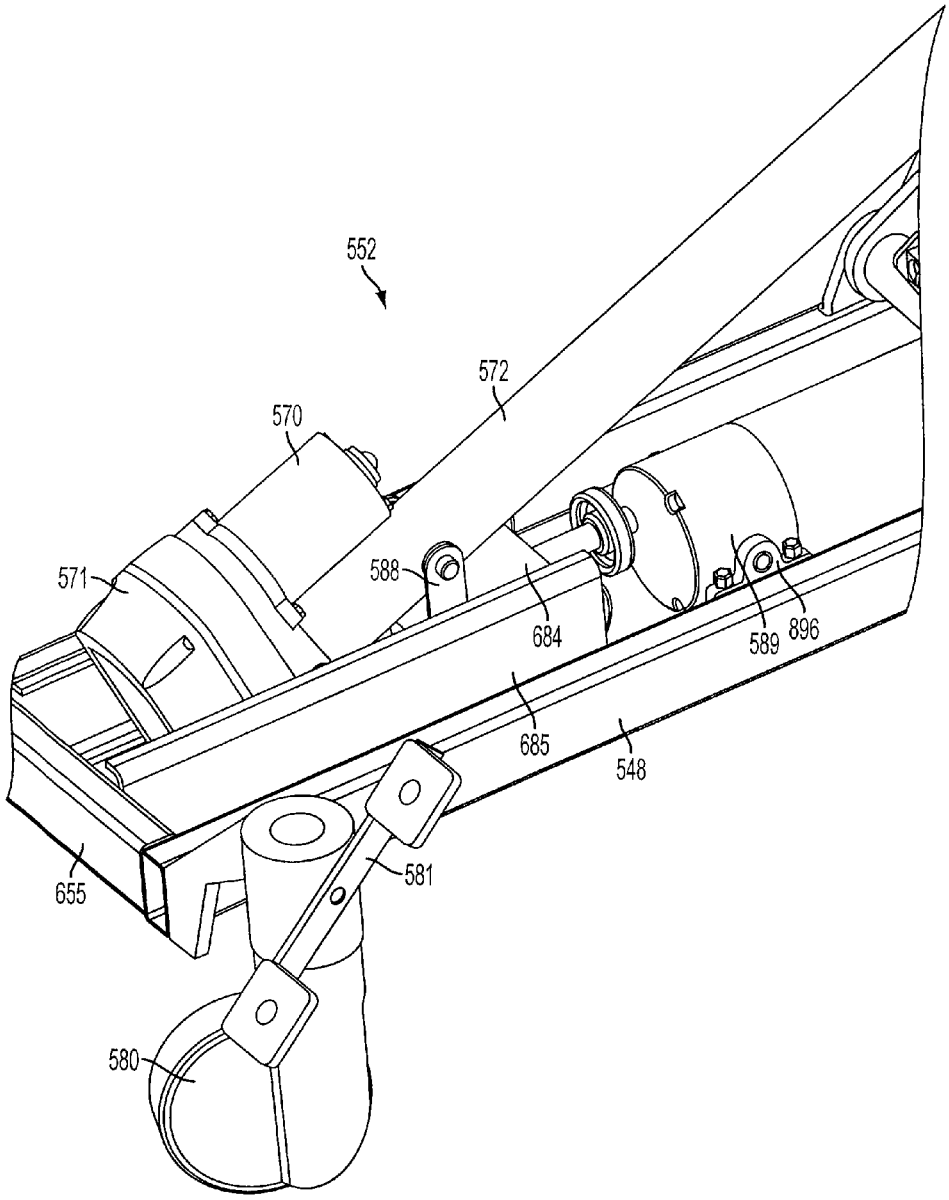
FIG. 9 is a side elevation view of a cart actuator assembly of the bed of FIG. 5.
Figure 10:
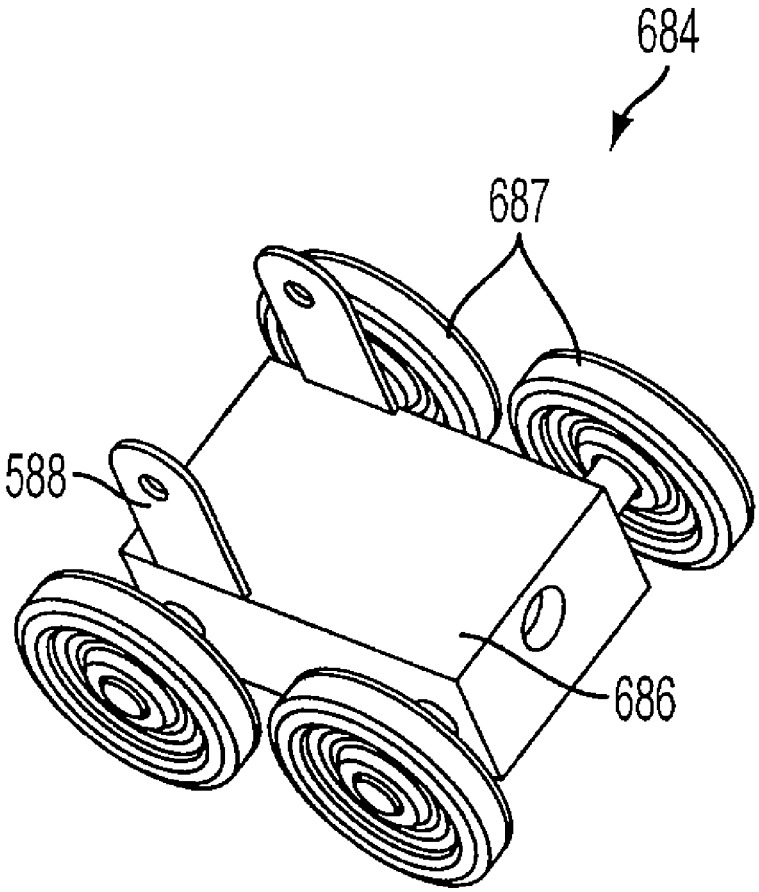
FIG. 10 is a side elevation view of a cart included in the cart actuator assembly shown in FIG. 9.

As shown in FIGS. 9 and 10, cart actuator assembly 683 may couple tilting actuator assembly 552 to head member 655. Cart actuator assembly 683 may include a cart 684, a cart track 685 and a cart actuator 589. Cart 684 may include a cart body 686 that supports cart wheels 687 and a cart lug 588. Cart body 686 may also include an interface for cart actuator 589. Cart actuator 589 may be pivotally coupled to base rails 548 through pillow blocks 896. Tilting actuator assembly 552 may be pivotally coupled to cart lug 588 such that an angle C with respect to base rails 548 can vary during operation.

Tilting actuator assembly 552 may be a linear actuator that includes a motor 570, a motor coupling 571 and a telescoping arm 572. An actuator pivot lug 573 may be coupled to telescoping arm 572 at an end opposite from motor coupling 571. Tilting actuator assembly 552 may be any commercially available linear actuator assembly, such as CC Linear Actuators from Nook Industries, Inc. of Cleveland, Ohio, capable of tilting deck assembly 501, which may be substantially heavier than deck assembly 101. For example, an embodiment of deck assembly 101 weighs approximately 185 lbs. and an embodiment of deck assembly 501 weighs approximately 500 lbs.

Actuator pivot lug 573 may be coupled to pivot arm 569. Pivot arm 569 may be pivotally coupled to a pivot arm lug 599 that is secured to a pivot arm support 698. Support 698 may extend between base rails 548 near foot member 643. Pivot arm wheels 697 may be coupled to pivot arm 569 at an end opposite from pivot arm lug 599.

Deck assembly 501 may be coupled to base assembly 540 at three points. Foot pivot lugs 690 of upper frame 504 may be pivotally coupled to apertures in upper ends 545 of leg members 544 and pivot arm wheels 697 are received within track 621. Deck assembly 501 may be supported at those three points in both a prone or upright position.

In one embodiment, deck assembly 501 may be tilted from the prone position toward an upright position, as shown in FIG. 7, by extending telescoping arm 572 of tilting actuator assembly 552. The extension of telescoping arm 572 causes pivot arm 569 to rotate such that an angle D (shown in FIG. 5) increases. As pivot arm 569 rotates, pivot arm wheels 697 move with respect to track 621 in the direction of footboard 508. The motion of pivot arm wheels 697 with respect to track 621 causes deck assembly 501 to rotate about a pivot axis R corresponding to foot pivot lugs 690. During the tilting process, cart actuator 589 and leg member actuator 592 are held stationary. In the present embodiment, the combined weight of the components of base assembly 540 acts as the counterweight. However, a separate counterweight may be added to base assembly 540.

As mentioned previously in one embodiment, deck assembly 501 may be moved vertically while it remains horizontal. In order to accomplish such horizontal motion, leg members 544 and pivot arm 569 are moved in a scissor-like motion with respect to each other. In particular, the output arm of actuator 592 may extend and push pivot arm 591 causing an increase in angle A and a corresponding height increase of upper ends 545 of leg members 544. Simultaneously, the output arm of cart actuator 589 may be retracted pulling cart 684 and tilting actuator assembly 552 and causing an increase in angle D and a corresponding height increase of the upper end of pivot arm 569. It should be appreciated that the cart and cart actuator may be omitted if the tilting actuator assembly is capable of providing sufficient force and the full range of motion of the combined tilting actuator assembly and cart of the embodiment described above.

A power supply box (not shown) may be mounted to deck assembly 501 and electrically coupled to relay switches provided on a control panel (not shown). Bed 500 may be powered by 120 VAC power or 12 VDC.

In an embodiment utilizing 12 VDC power, the power supply box may include an AC to DC power converter and a 12 VDC battery. The control logic and power converter may be configured such that AC power entering the power converter from a wall plug is converted to DC power to charge the battery. The various actuators and any accessories may then be powered by DC power directly from the battery. Such a configuration allows bed 500 to be temporarily operated after loss of AC power without interruption.

The power supply box may also contain control logic for controlling the tilting, elevating and lowering of deck assembly 501 as well as for controlling the caster locks 581. For example, sensors may be provided on deck assembly 501 and/or on the output arms of cart actuator 589 and/or leg member actuator 592. The signals from such sensors may be processed by the control logic to assure the safe operation of the bed. In particular, the control logic may require that deck assembly 501 be in a fully lowered position prior to tilting. Similarly, the control logic may require that deck assembly 501 be in a prone position prior to elevating or lowering. In addition, the control logic may require casters 580 to be locked before raising, lowering or tilting deck assembly 501. Further, feedback from sensors on the output arms of the actuators or sensors on deck assembly 501 may be used by the control logic to assure that deck assembly 501 remains horizontal when it is raised or lowered. Any suitable sensor known in the art may be employed, for example linear variable displacement transducers (LVDT).

Additional accessories, such as a reading light and laser lights may be included on bed 500. Such reading light and laser lights may be configured as described above with respect to bed 100.

The design of bed 500 also reduces pinch points during the tilting of deck assembly 501 and provides for a lower deck assembly 501 than conventional beds. In particular, the configuration of leg members 544, telescoping arm 572 and pivot arm 569 assure that no pinch points are created between those components and upper frame 504 at any time while deck assembly is tilted between the prone and upright positions or while deck assembly 501 is raised and lowered.

The many features and advantages of the invention are apparent from the detailed specification. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An adjustable bed, comprising:

a deck assembly; and a base assembly that provides support for the deck assembly, wherein the base assembly includes two leg members coupled to the deck assembly at two contact points along a rotary axis, and a pivot arm coupled at a first end to a pivot arm support on the base assembly and wherein a second end of the pivot arm is slidably received within a track, wherein the base assembly further includes a first actuator having a telescoping arm that is coupled to the pivot arm between the first end and the second end of the pivot arm, wherein the first actuator is adapted to pivot the pivot arm such that the second end of the pivot arm moves with respect to the track and thereby pivots the deck assembly about the rotary axis between an approximately vertical position and an approximately horizontal position, and wherein the base assembly further includes a second actuator adapted to pivot the two leg members when the deck assembly is in the approximately horizontal position.

2. The adjustable bed of claim 1, wherein the base assembly further includes a counterweight disposed in an area below the deck assembly.

3. The adjustable bed of claim 1, wherein a lower surface of the deck assembly is less than thirty inches from the ground when the deck assembly is in the approximately horizontal position.

4. The adjustable bed of claim 1, further comprising caster wheels.

5. The adjustable bed of claim 1, wherein the deck assembly further comprises:

a plurality of deck assembly actuators, each deck assembly actuator adapted to tilt a segmented portion of the deck assembly.

6. An adjustable bed, comprising:

a deck assembly; and a base assembly that provides support for the deck assembly, wherein the base assembly includes two leg members coupled to the deck assembly at two contact points along a rotary axis, and a pivot aim coupled at a first end to a pivot arm support on the base assembly and wherein a second end of the pivot arm is slidably received within a track, wherein the base assembly further includes a first actuator having a telescoping arm that is coupled to the pivot arm between the first end and the second end of the pivot arm, wherein the first actuator is adapted to pivot the pivot arm such that the second end of the pivot arm moves with respect to the track and thereby pivots the deck assembly about the rotary axis between an approximately vertical position and an approximately horizontal position, wherein the deck assembly further includes a foot end and a footboard extending from the foot end of the deck assembly, and wherein the deck assembly has a longitudinal length approximately equal to a combined length of the base assembly and the footboard when the deck assembly is in the approximately vertical position.

7. The adjustable bed of claim 6, wherein the footboard includes a non-slip surface.

8. An adjustable bed, comprising:

a deck assembly; and a track coupled to a lower surface of the deck assembly;

a base assembly that provides support for the deck assembly, wherein the base assembly includes:

a frame, two leg members coupled between the frame and the deck assembly, wherein each of the two leg members can pivot with respect to the frame and with respect to the deck assembly, a pivot arm coupled at a first end to a pivot arm support on the base assembly and wherein a second end of the pivot arm is slidably received within the track, a first actuator having a telescoping arm that is coupled to the pivot arm between the first end and the second end of the pivot arm, wherein the first actuator is adapted to pivot the pivot arm such that the second end of the pivot arm moves with respect to the track and thereby pivots the deck assembly between an approximately vertical position and an approximately horizontal position, and a second actuator coupled to the two leg members, wherein the second actuator is adapted to pivot the two leg members with respect to the frame when the deck assembly is in the approximately horizontal position.

9. An adjustable bed, comprising:

a deck assembly; and a track coupled to a lower surface of the deck assembly;

a base assembly that provides support for the deck assembly, wherein the base assembly includes:

a frame having a foot member, two base rails, and a head member, two leg members, wherein each leg member is pivotally coupled to a respective base rail, wherein each leg member extends upward from the respective base rail and away from the head member, and wherein each leg member is pivotally coupled to the deck assembly, a leg member actuator coupled to the leg members and adapted to pivot the leg members so as to change an angle formed between the leg members and the base rails when the deck assembly is in an approximately horizontal position, a pivot arm coupled at a first end to a pivot arm support on the base assembly and wherein a second end of the pivot arm is slidably received within the track, a tilting actuator assembly having a telescoping arm coupled to the pivot arm between the first end and the second end of the pivot arm, wherein the tilting actuator is adapted to pivot the pivot arm such that the second end of the pivot arm moves within the track and thereby pivots the deck assembly between an approximately vertical position and the approximately horizontal position, a cart actuator assembly coupled to the frame and pivotally coupled to the tilting actuator assembly, wherein the cart actuator assembly is adapted to pivot the tilting actuator assembly so as to change an angle formed between the tilting actuator assembly and the base rails, and a plurality of casters coupled to the frame for allowing the bed to be rolled on a support surface.

* * * * *